US008479434B2

(12) United States Patent
Davis et al.

(10) Patent No.: US 8,479,434 B2
(45) Date of Patent: Jul. 9, 2013

(54) ACCESSORY INTERFACE SYSTEM

(75) Inventors: Jason M. Davis, Loogootee, IN (US); Brian P. Dean, Bloomington, IN (US); Brandon R. Clarke, Bloomington, IN (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 185 days.

(21) Appl. No.: 13/168,459

(22) Filed: Jun. 24, 2011

(65) Prior Publication Data

US 2012/0325077 A1 Dec. 27, 2012

(51) Int. Cl.
*F41G 1/387* (2006.01)

(52) U.S. Cl.
USPC ..... 42/124; 42/72

(58) Field of Classification Search
USPC ..... 42/90, 71.01, 124, 72
See application file for complete search history.

(56) References Cited

U.S. PATENT DOCUMENTS 6,779,288 B1 * 8/2004 Kim ..... 42/72
8,316,574 B1 * 11/2012 Swan ..... 42/146
8,336,243 B2 * 12/2012 Langevin et al. ..... 42/71.01

* cited by examiner

*Primary Examiner* — Stephen M Johnson
(74) *Attorney, Agent, or Firm* — Christopher A. Monsey

(57) ABSTRACT

An apparatus for mounting accessories on a weapon mount. One embodiment of the apparatus includes an accessory interface system having a forward module coupled to a mounting module. The mounting module of the accessory interface system mounts on a weapon mount. The forward module of the accessory interface system provides a plurality of surfaces for mounting weapon accessories.

29 Claims, 12 Drawing Sheets

ACCESSORY INTERFACE SYSTEM

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon.

BACKGROUND OF THE INVENTION

In the status quo, heavier weapons or equipment items, e.g., heavy machine guns, are mounted on stands, including portable stands, to assist with the stability and ease of using such items. Stands may be used in a wide variety of end uses including on moving platforms, portable applications, fixed sites, submersible vehicles, moving vehicles, airborne applications, to name a few. Users of these mounted guns also desire the use of accessories with the weapons. For example, a user desires using targeting aids, such as a light, laser, or sight, to help increase the effectiveness of using the equipment item or weapon. Additionally, the user may desire increased protection or armament while using the weapon. For example, a user desires using a ballistic shield. An accessory might be attached directly to an equipment item or weapon or might be attached to a rail system that is connected to the weapon. For example, a laser sighting device is attached to a weapon near the rear of the weapon and a ballistic shield is attached to the weapon in between the laser sighting device and the front of the weapon. The ballistic shield is also in between the front of the weapon and the user of the weapon. A disadvantage to this approach is the possibility of obstruction by the shield, resulting in "splash-back" of laser radiation. Such splash-back may "bloom-out" a weapon user's night vision, effectively blinding the user. It can also be an eye safety concern, depending on the location of personnel in relation to any reflected laser radiation. Another difficulty with attempts to create accessory mounting systems is creating a mounting system which is compatible with more than one shield or shroud design which also meets other needs and satisfies design, manufacturing constraints, a wide variety of real world field events and failure modes, mounting scenarios, equipment/weapon types, equipment interaction limitations, or environmental constraints, such as described in this application.

In the case of some other weapons, especially heavy equipment or weapon systems, rail systems might mount directly to the weapon or to the shroud of the weapon. Such direct or shroud mounted systems place undesired stresses on the weapon itself. Furthermore, weapon shrouds are also typically non-uniform in positioning, often resulting in the rail system, and hence the accessories, being in an undesired and often non-uniform, unusable, and unreliable orientation which creates unpredictable, damaging, or undesired effects in field use. Thus, it would be desirable to have an accessory mounting system that does not mount on the weapon or the shroud of the weapon. Furthermore, it would be desirable to have an accessory mounting system that is uniformly positioned and modular. Additional features such as minimized weight and strength are also desired by users in combination with the various desired features.

Accessory mounting systems have limited capabilities and can be overloaded by the weight and orientation of the accessories connected to its components, e.g., a rail system. An overloaded rail can impact the area connected to the rail system. For example, an overloaded rail system on a weapon or weapon shroud can warp the weapon or the weapon shroud, thereby damaging the weapon or weapon shroud and affecting the performance of the weapon. Therefore, it would be desirable to have a rail system that addresses overloading of the rail system.

With increased use of accessories on a rail system, also comes the increased management of collateral items that accompany the accessories. For example, many accessories have collateral items, e.g., cables, (e.g., electrical, power, control, and other wise) coupled to the accessory that must be located somewhere. The cable can dangle from the weapon, which could significantly affect the user of the weapon and his use of the weapon, or, preferably, it can be managed on the weapon. Therefore, it would be desirable to have an accessory mounting system that also addresses management of collateral items.

DETAILED DESCRIPTION OF THE INVENTION

In the following detailed description, reference is made to the accompanying drawings, which form a part hereof, and in which is shown by way of illustration specific exemplary embodiments of the invention. These embodiments are described in sufficient detail to enable those of ordinary skill in the art to make and use the invention, and it is to be understood that structural, logical, or other changes may be made to the specific embodiments disclosed without departing from the spirit and scope of the present invention.

The invention discloses an accessory interface system that enables the mounting of weapon accessories to a weapon mount. The invention also discloses an accessory interface system that enables uniform positioning of accessories and modularity. The invention also discloses an accessory interface system that addresses overloading of the rail system. The invention also discloses an accessory interface system that addresses management of collateral items.

Figure 1:
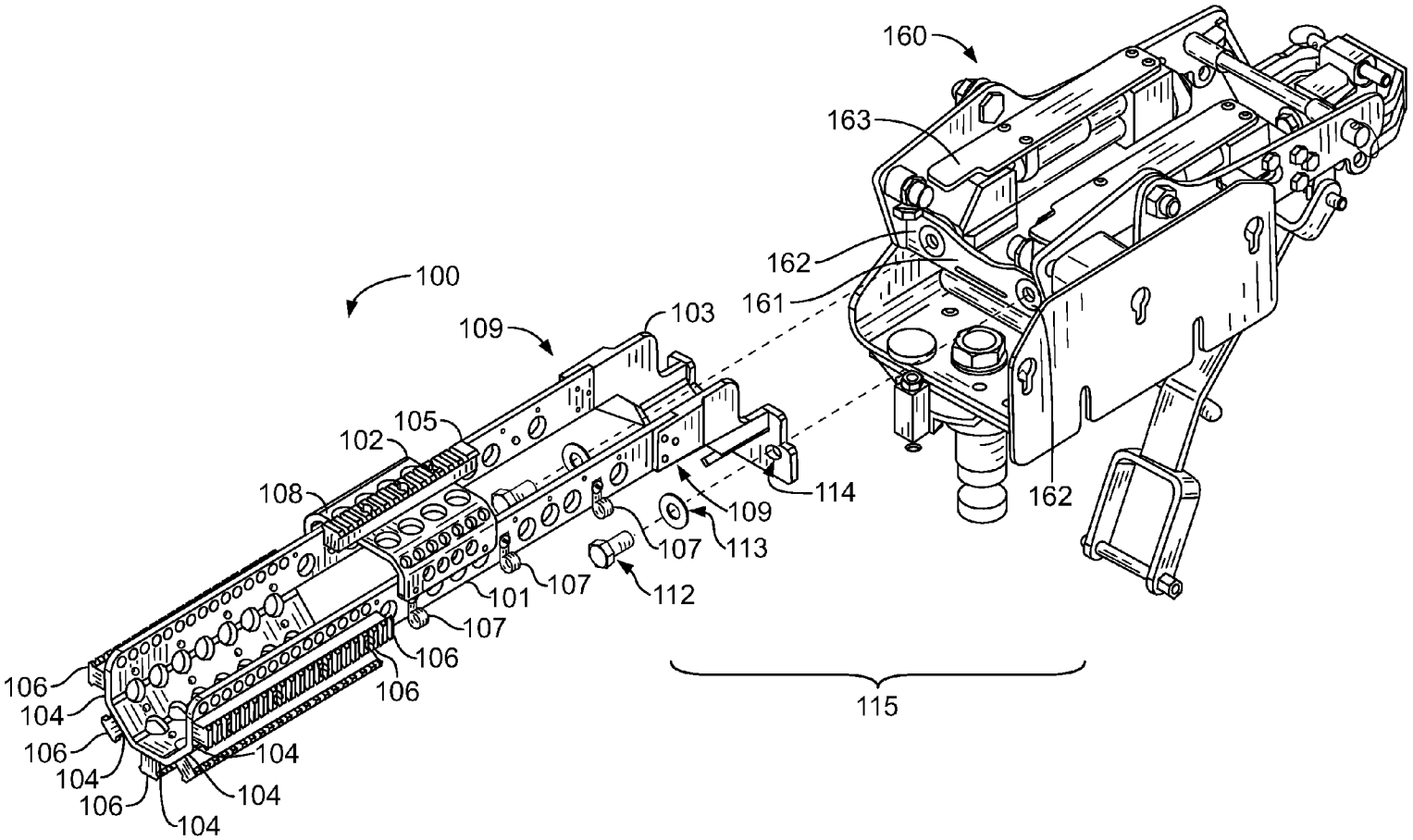
FIG. 1 depicts an accessory interface system in accordance with an exemplary embodiment.
Figure 2A:
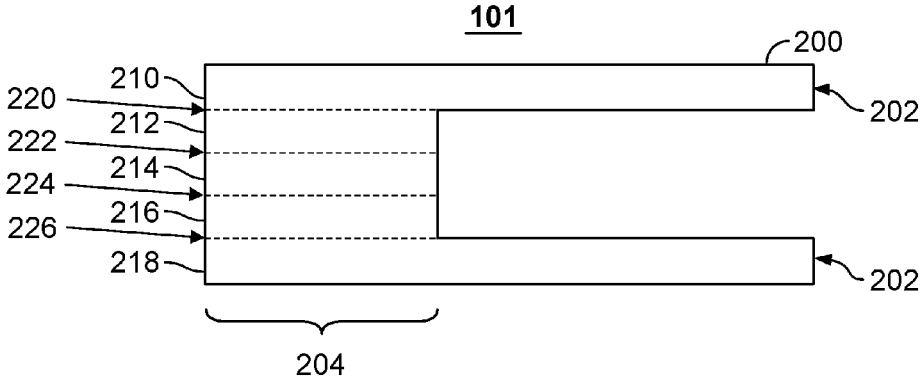
FIGS. 2(*a*)-2(*d*) depict the forward module of FIG. 1 in greater detail.
Figure 2B:
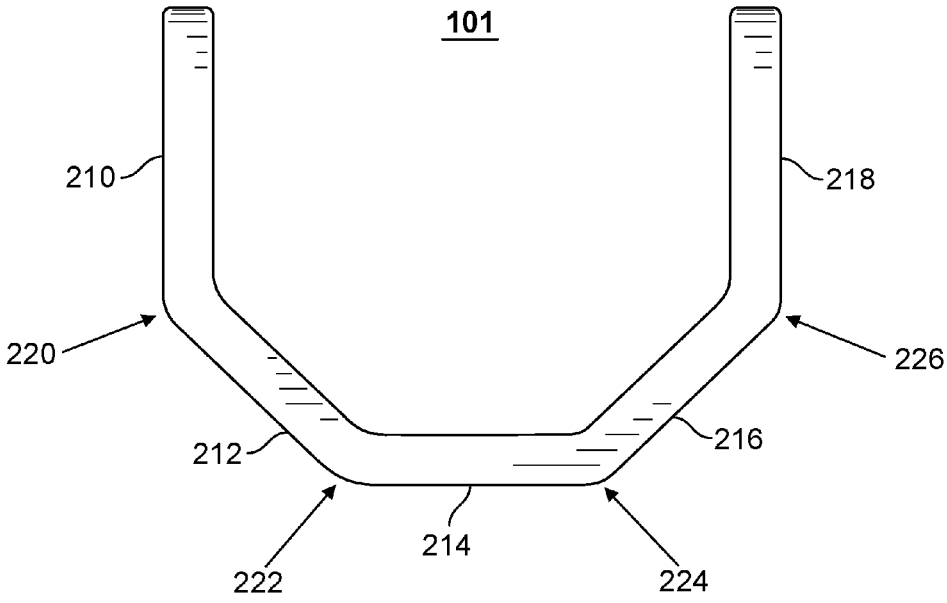
Figure 2C:
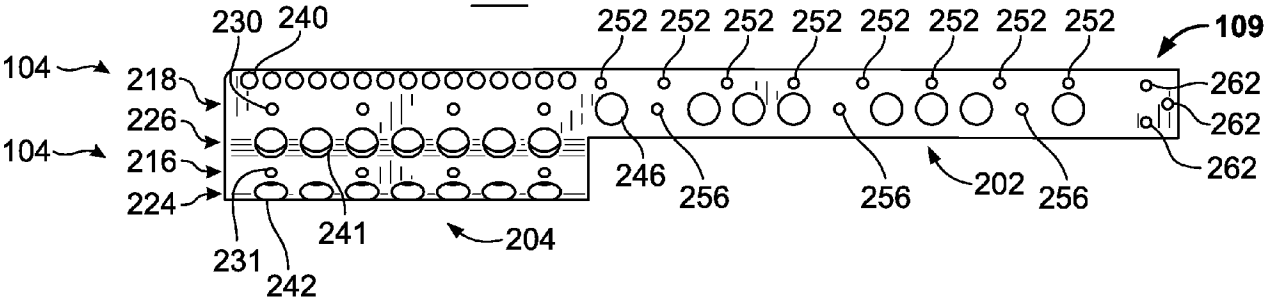
Figure 2D:
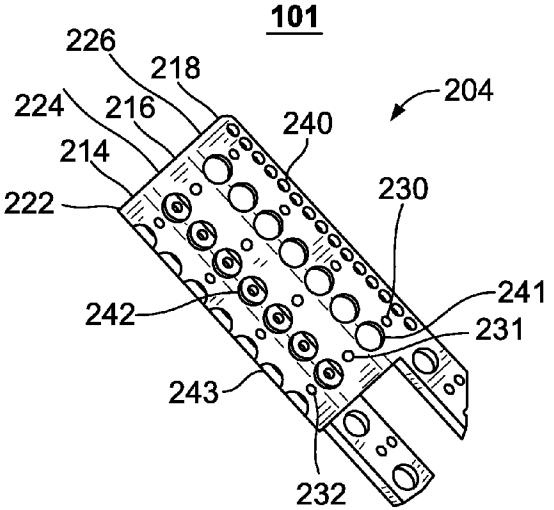
Figure 3A:
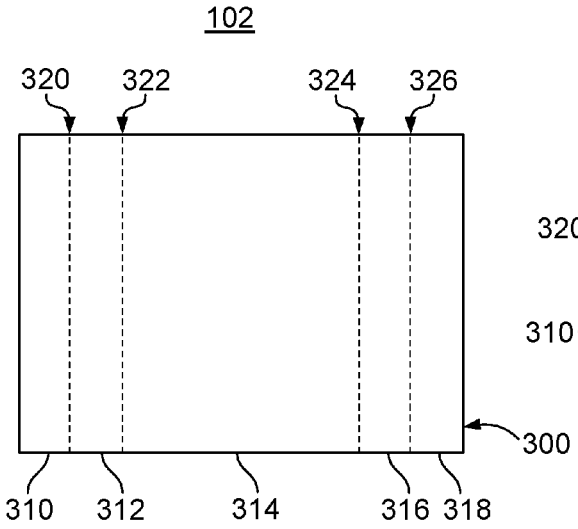
FIGS. 3(*a*)-3(*d*) depict the ancillary rail module of FIG. 1 in greater detail.
Figure 3B:
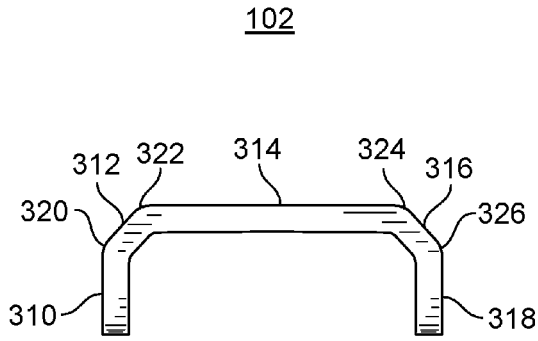
Figure 3C:
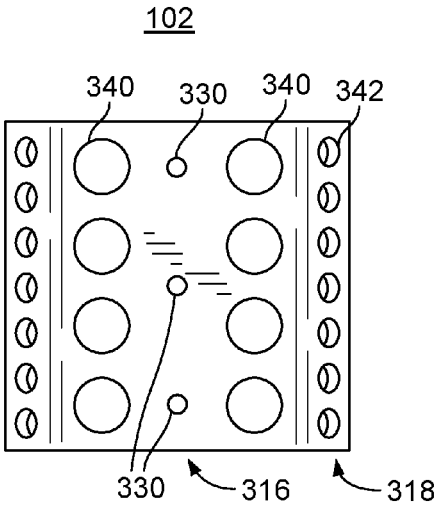
Figure 3D:
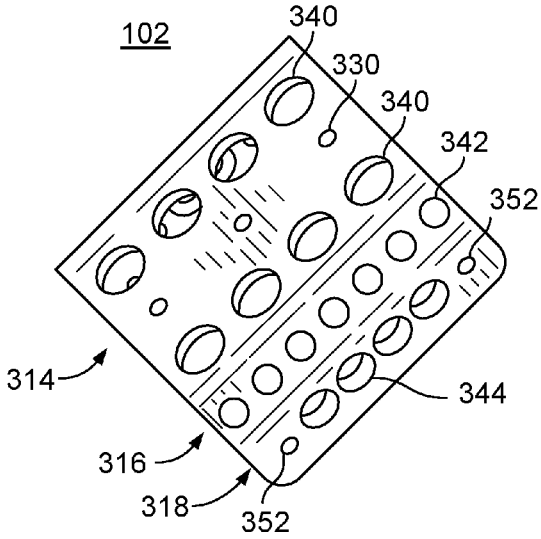
Figure 4A:
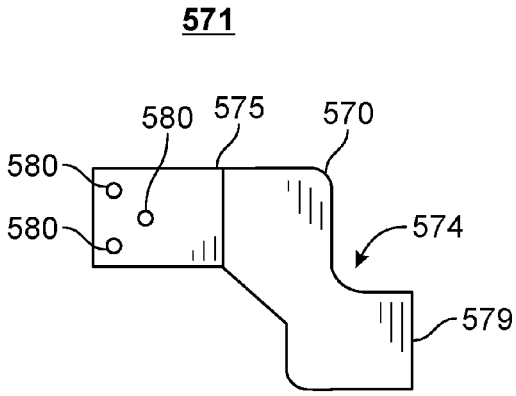
FIGS. 4(*a*)-4(*f*) depict the mounting module of FIG. 1 in greater detail.
Figure 4B:
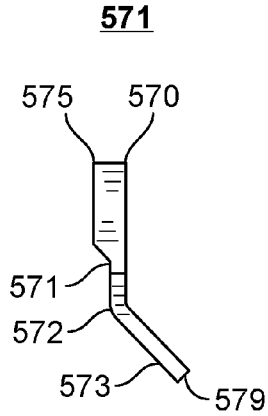
Figure 4C:
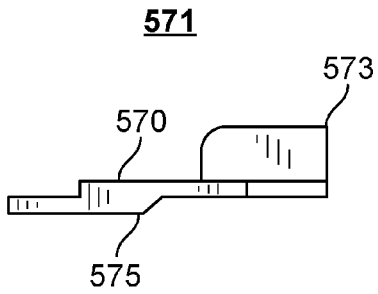
Figure 4D:
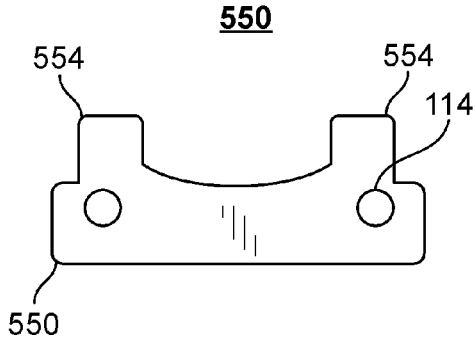
Figure 4E:
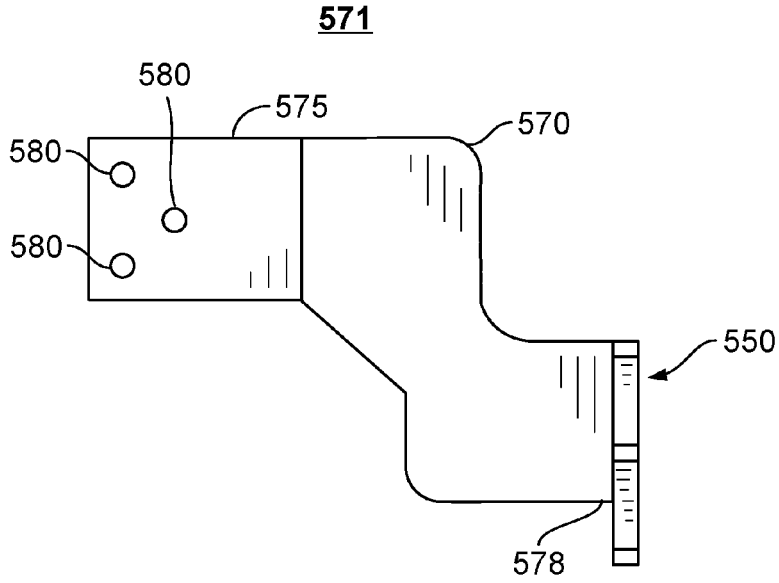
Figure 4F:
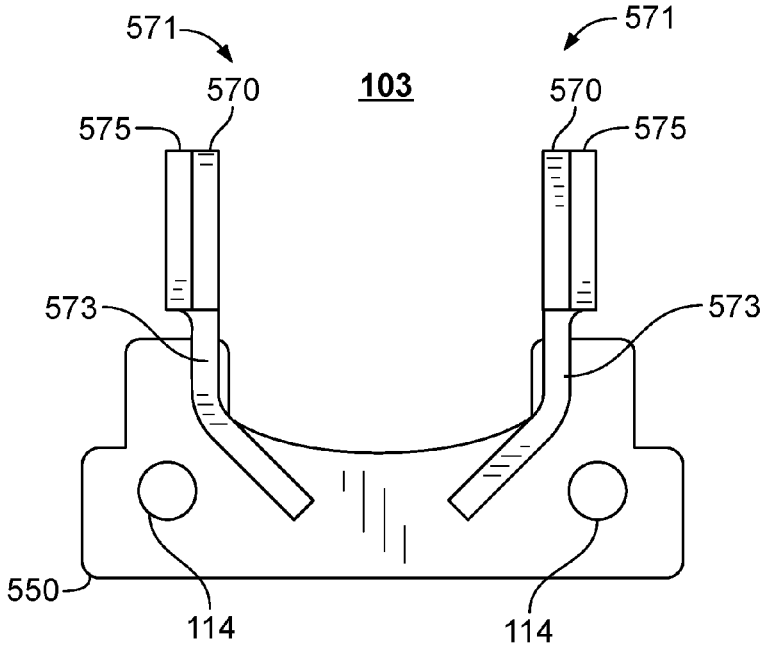

An accessory interface system 100 is depicted in FIG. 1 in accordance with an exemplary embodiment of the invention. An accessory interface system 100 includes a forward module 101, an ancillary rail module 102, and a mounting module 103. The exemplary accessory interface system 100 employs a dual load bearing or traverse portions 202 (FIG. 2(*a*)) or beam design which is coupled into a buffer system 163 of a weapon mount 160, using a fastening system 115 coupled to a fastening system of the weapon mount. In this embodiment, a weapon mount cross member 161 is part of the buffer system 163. However, another embodiment of an alternative embodiment for the invention can include substitution of a dual load bearing or beam structure that can incorporate a single load bearing structure or more than two load bearing structures provided the below and above referenced design parameters, including problems associated with elevation or freedom of movement of a mounted equipment item, are adequately addressed and evaluated in required testing. The fastening system 115 includes, for example, bolts 112 and washers 113 employed through apertures 114 of the accessory interface system 100. The bolts 112 are received and coupled to the fastening system of the weapon mount, for example, the bolts 112 are received through apertures 162 and coupled to respective nuts or threaded sections (for simplicity, not shown) in the interior of a buffer system 163.

The underside of the forward module 101 is open for the majority of its length, to reduce the likelihood of obstructing a vertical path of a weapon that is mounted in the weapon mount 160, thus increasing the likelihood of enabling the weapon to achieve full depression. Five mounting surfaces 104 for accessories are provided at the free end, e.g., the front end or end away from the weapon mount 160, of the load bearing or traverse portions of the accessory interface system 100. Each mounting surface 104 includes, for example, a rail system 106, is equidistant from a common centerline located within the accessory interface system 100. In a preferred approach, the common centerline is substantially the same as a centerline of a weapon mounted in the weapon mount 160 and accessory interface system 100, e.g., where the centerline is also the centerline of the interior of the barrel of the weapon. Along its length, the accessory interface system 100 contains collateral clamps 107, e.g., cable clamps, allowing management of accessory collaterals, e.g., cables. For example, the accessory collaterals are routed from an accessory mounted on a rail system 106 back to the rear of weapon system for remote operation.

In a preferred approach, an accessory interface system 100 also comprises an upward arching ancillary rail module 102, which is mounted on forward module 101 above a weapon. The ancillary rail module 102 has, on its top side, a mounting surface 108 for accessories. The mounting surface 108 includes, for example, a rail system 105, which is equidistant from the common centerline located within the accessory interface system 100, being the same common centerline that the mounting surface 104 is equidistant from. The ancillary rail module 102 can be mounted at different locations along the top of the forward module 101. Further descriptions of the accessory interface system 100 are provided below.

FIGS. 2(*a*)-2(*d*) depict the forward module 101 in greater detail. FIG. 2(*a*) depicts a top view of an initial stage of formation of a forward module 101 of FIG. 1. In an exemplary embodiment, forward module 101 is formed from a "U" shaped, substantially flat metal blank 200, where the metal is quarter inch (0.25") metal. Metal blank 200 has an interface portion 204 and two load bearing or traverse portions 202. The interface portion 204 is substantially rectangularly shaped having an approximate height being six and three quarter inches (6¾") and a width of approximately eight inches (8"). Each load bearing or traverse portion 202 is approximately one and one half inches (1½") in height and thirteen inches (13") in width. A top edge of one of the load bearing or traverse portions 202 is shared by a top edge of interface portion 204. A bottom edge of other of the load bearing or traverse portions 202 is shared by the bottom edge of interface portion 204.

The interface portion 204 is subdivided into further substantially rectangular portions: first portion 210, second portion 212, third portion 214, fourth portion 216 and fifth portion 218 as depicted in FIG. 2(*a*). First portion 210 and fifth portion 218 are approximately one and one half inches (1½") in height. Second portion 212, third portion 214, and fourth portion 216 are approximately one and one quarter inches (1½") in height. The interface portion 204 also includes bend regions: first bend region 220, second bend region 222, third bend region 224, and fourth bend region 226. The bend regions represent where the metal blank 200 is bent during formation to form the desired shape of the forward module 101.

Metal blank 200 is bent along first bend region 220 to form a forty five (45) degree between a plane formed by the face of first portion 210 and a plane formed by the face of second portion 212. Metal blank 200 is further bent along second bend region 222 to form a forty five (45) degree between a plane formed by the face of second portion 212 and a plane formed by the face of third portion 214. Metal blank 200 is further bent along third bend region 224 to form a forty five (45) degree between a plane formed by the face of third portion 214 and a plane formed by the face of fourth portion 216. Metal blank 200 is further bent along fourth bend region 226 to form a forty five (45) degree between a plane formed by the face of fourth portion 216 and a plane formed by the face of fifth portion 218.

FIG. 2(*b*) depicts a front perspective view of forming an intermediate stage of forward module 101 of FIG. 1. FIG. 2(*b*) shows the interface portion 204 after being bent. As a result of the bending, first portion 210 is at a 45 degree angle with respect to second portion 212. Second portion 212 is at a 45 degree angle with respect to third portion 214. Third portion 214 is at a 45 degree angle with respect to fourth portion 216. Fourth portion 216 is at a 45 degree angle with respect to fifth portion 218.

FIG. 2(*c*) depicts a side perspective view of forming a later stage of forward module 101 of FIG. 1. FIG. 2(*c*) shows the interface portion 204 and the load bearing or traverse portions 202 after apertures are included. Although only one side of forward module 101 is depicted, the one side is representative of apertures applied to the other side, such that both sides are substantially symmetric.

A plurality of apertures is applied to mounting surfaces 104 (FIG. 1) to permit mounting of a rail system 106 (FIG. 1) on each of the mounting surfaces, respectively. Thus, first portion 210, second portion 212, third portion 214, fourth portion 216, and fifth portion 218 include a plurality of apertures to couple a rail system 106 to the respective portion. Thus, fifth portion 218 includes a plurality of, e.g., four (4) apertures 230; fourth portion 216 includes a plurality of, e.g., four (4) apertures 231. Although not depicted in FIG. 2(*c*), third portion 214, second portion 212 and first portion 210 include a plurality of, e.g., four (4) apertures. The size, number, and orientation of apertures depend on the rail system to be coupled to so that the apertures in the mounting surface correspond to apertures in the rail system so that the rail system 106 can be coupled to the mounting surface 104. The apertures, e.g., apertures 230, in the portions, e.g., fifth portion 218, are substantially equally spaced and co linear such that a rail system is capable of being fastened to all the portions. For example, a rail system is fastened to fifth portion 218 using apertures 230. The same rail system is fastened, at a different time, to fourth portion 216 using apertures 231. The same rail system can also be fastened at different times, to third portion 214, second portion 212 and first portion 210 using the respective apertures in the portions. Each rail system 106 is substantially the same height so that the top surface of each rail system mounted on a mounting surface is substantially equidistant from a common center line of the weapon (i.e., the heights of the rail systems are substantially the same). Preferably, each rail system 106 is mounted such that an imaginary line passing through the center line of the rail system 106 is co-planer to the centerline of the weapon. Thus, an equipment item mounted on a first rail system 106 is same distance to the center line of the weapon as when the equipment item is mounted on a second rail system 106. Additionally, the alignment of the equipment item mounted on a first rail system 106 is same alignment to the center line of the weapon as when the equipment item is mounted on a second rail system 106. Thus, ideally, once an equipment item has a preferred alignment on a first rail system 106 with respect to the center line of the weapon, when the equipment item is relocated to a second rail system 106, the equipment item should not require any additional adjustment to have the same alignment to the center line of the weapon as when the equipment item was on the first rail system.

Portion 218, and similarly portion 210 (not shown) include a plurality of weight reduction apertures 240 which are used to remove some of the weight of the forward module 101 without impacting the effectiveness of forward module 101. Fourth bend region 226 and third bend region 224, and similarly second bend region 222 (not shown) and first bend region 220 (not shown), also include a plurality of weight reduction apertures—apertures 241 in fourth bend region and apertures 242 in third bend region. Although the apertures are shown to be significantly in the bend regions, the apertures are not limited and can be large enough such that they also encompass part of portion, e.g., fifth portion 218.

Load bearing or traverse portions 202 (although only one is depicted in FIG. 2(*c*), the other, not shown, load bearing or traverse portion 202, includes similar apertures in comparable locations) include a plurality of apertures. Load bearing or traverse portions 202 include a plurality of apertures 252 for securing an ancillary rail module 102 (FIG. 1). Load bearing or traverse portions 202 include a plurality of apertures 256 for securing accessory collateral clamps 107 (FIG. 1). Load bearing or traverse portions 202 includes a plurality of weight reduction apertures 246 which are used to remove some of the weight of the forward module 101 without impacting the effectiveness of forward module 101. The back portion of the forward module 101 is designed to couple with mounting module 103. As such, load bearing or traverse portions 202 include a plurality of apertures 262 for securing forward module 101 to mounting module 103. The apertures 262 correspond to apertures in mounting module 103.

The size and orientation of the weight reduction apertures, e.g., apertures 240, 241, 246, etc, are subject to the designer's wishes balanced with the impact on the efficacy of the weapon system including the impact on accessory interface system 100.

FIG. 2(*d*) depicts a portion of the accessory interface system 100 in a perspective view showing more of the bottom of interface portion 204. As depicted in FIG. 2(*d*), third portion 214, fourth portion 216 and fifth portion 218 include a plurality of apertures to couple a rail system 106 to the respective portion. Third portion 214 includes a plurality of, e.g., four (4) apertures 232, fourth portion 216 includes a plurality of, e.g., four (4) apertures 232, and fifth portion 218 includes a plurality of, e.g., four (4) apertures 230, for respectively being coupled to a rail system 106. Although described with reference to using rail system 106, the invention is not limited and can use any appropriate rail system.

As noted above, portion 218, portion 216, and portion 214 include a plurality of weight reduction apertures which are used to remove some of the weight of the forward module 101 without impacting the effectiveness of forward module 101. Fourth bend region 226 and third bend region 224, and similarly second bend region 222 (also include a plurality of collinear weight reduction apertures—apertures 241 in fourth bend region 226, apertures 242 in third bend region 224, and apertures 243 in the second bend region 222. Although the apertures are shown to be significantly in the bend regions, the apertures are not limited and can be large enough such that they also encompass part of portion, e.g., fifth portion 218.

FIGS. 3(*a*)-3(*d*) depict the ancillary rail module 102 in greater detail. FIG. 3(*a*) depicts a top view of an initial stage of formation of an ancillary rail module 102 of FIG. 1. In an exemplary embodiment, ancillary rail module 102 is formed from a substantially rectangularly shaped, substantially flat metal blank 300, where the metal is quarter inch (0.25") metal being approximately four inches (4") in height and six and one quarter inches (6¼") in width.

The metal blank 300 is subdivided into further substantially rectangular portions: first portion 310, second portion 312, third portion 314, fourth portion 316 and fifth portion 318 as depicted in FIG. 3(*a*). First portion 310 and fifth portion 318 are approximately one inch (1") in width, second portion 312 and fourth portion 316 are approximately one half inch (½") in width and third portion 314 is approximately three and one half inches (3½") in width. The metal blank 300 also includes bend regions: first bend region 320, second bend region 322, third bend region 324, and fourth bend region 326. The bend regions represent where the metal blank 300 is bent during formation to form the desired shape of the ancillary rail module 102.

Metal blank 300 is bent along first bend region 320 to form a forty five (45) degree between a plane formed by the face of first portion 310 and a plane formed by the face of second portion 312. Metal blank 300 is further bent along second bend region 322 to form a forty five (45) degree between a plane formed by the face of second portion 312 and a plane formed by the face of third portion 314. Metal blank 300 is further bent along third bend region 324 to form a forty five (45) degree between a plane formed by the face of third portion 314 and a plane formed by the face of fourth portion 316. Metal blank 300 is further bent along fourth bend region 326 to form a forty five (45) degree between a plane formed by the face of fourth portion 316 and a plane formed by the face of fifth portion 318.

FIG. 3(*b*) depicts a front perspective view of an intermediate stage of forming an ancillary rail module 102. FIG. 3(*b*) shows the ancillary rail module after being bent. As a result of the bending, first portion 310 is at a 45 degree angle with respect to second portion 312. Second portion 312 is at a 45 degree angle with respect to third portion 314. Third portion 314 is at a 45 degree angle with respect to fourth portion 316. Fourth portion 316 is at a 45 degree angle with respect to fifth portion 318.

FIG. 3(*c*) depicts a top perspective view of a later stage of forming an ancillary rail module 102. As depicted in FIG. 3(*c*), a plurality of apertures is applied to mounting surface 104 (FIG. 1) to permit mounting of a rail system 105 (FIG. 1) on ancillary rail module 102. Thus, third portion 314 includes a plurality of apertures, e.g., 330, to couple a rail system 105 (FIG. 1) to the portion 314. The size, number, and orientation of apertures depend on the rail system to be coupled to so that the apertures in the mounting surface correspond to apertures in the rail system so that the rail system 105 can be coupled to the ancillary module 102. Although described with reference to using rail system 105, the invention is not limited and can use any appropriate rail system.

Ancillary rail module 102 includes a plurality of weight reduction apertures 340, 342 which are used to remove some of the weight of the ancillary rail module 102 without impacting the effectiveness of forward module 101 and the ancillary rail module 102. Apertures 340 are primarily located in portion 314; apertures 342 are primarily located in regions 312, 316, and apertures are also located in portions 310, 318 (not shown). Although the apertures are shown to be significantly in the bend regions, the apertures are not limited and can be large enough such that they also encompass part of a bend portion, e.g., fifth portion 322.

FIG. 3(*d*) depicts a perspective view of a later stage of forming the ancillary rail module 102. FIG. 3(*d*) depicts the third portion 314, fourth portion 316, and fifth portion 318. In third portion 314 can be seen apertures 330 for mounting a rail system 105, and weight reduction apertures 340. Weight reduction apertures 342 can be seen in fourth portion 316 and weight reduction apertures 344 can be seen in fifth portion 318. Fifth portion 318 also includes apertures 352 for mounting the ancillary rail module 102 onto the forward module 101. The size, number and orientation of apertures 352 depend on the size, number, and orientation of the corresponding apertures 252 (FIG. 2(*c*)) to mount and couple the ancillary rail module 102 to the forward module 101.

FIGS. 4(*a*)-(*d*) depict the mounting module 103 (FIG. 1) in greater detail. FIG. 4(*a*) depicts a side view of a portion of the mounting module, more specifically, one of the two support structures 571. Although only one support structure 571 is depicted and described in FIGS. 4(*a*)-4(*c*), there is a corresponding second structure being a mirror image of that described (as can be seen in FIG. 4(*f*)) with respect to support structure 571.

Support structure 571 includes a structural element section 570 and a coupling bracket section 575. In an exemplary approach, structural element section 570 has a substantially rectangular main body with a lobe 579 being below and dog-leg-right of the main body. Coupling bracket section 575 is substantially rectangular and having a height comparable to the height of the main body of the structural element section 570. Coupling bracket section 575 is placed such that a portion of coupling bracket section 575 has a side mating portion which is laterally offset from the main body of structural element section 570, and in this embodiment is machined as a single component. Coupling bracket section 575 has three (3) apertures 580. Apertures 580 are used to couple the mounting module 103 to the forward module 101 using corresponding apertures 262 (FIG. 2(*c*)). One embodiment includes notches 574 in the top, rear of support structure 571 which enables operation of certain weapons or equipment items having somewhat large controls on the sides of the weapon or equipment item without interfering with the operation of the weapon or equipment item.

FIG. 4(*b*) depicts a back view of a support structure 571. As seen in FIG. 4(*b*), support structure 571 includes a structural element section 570 and a coupling bracket section 575. Structural element section 570 includes a bend region 572 where the lobe 579 is bent with respect to an upper section of the structural element section 570. As a result of the bending, the bottom 573 of the lobe 579 allows for coupling of lobe 579 to support structure 571 in the interior of the mounting module 103 (see, for example, FIG. 4(*f*)).

FIG. 4(*c*) depicts a top view of a support structure 571. As seen in FIG. 4(*c*), support structure 571 includes a structural element section 570 and a coupling bracket section 575. Coupling bracket section 575 is on the exterior side of structural element section 570. As a result of the bending, the bottom 573 results in the interior side of structural element section 570.

FIG. 4(*d*) depicts a front view of a backplate 550, which includes two apertures 114 and a two lobes 554 extending slightly upward from the main body of the back plate 550. Apertures 114 are used to couple the backplate 550 to a weapon mount.

FIG. 4(*e*) depicts a side view of a backplate 550 being coupled to a support structure 571. The coupling bracket section 575, having apertures 580, is coupled to structural element section 570. Structural element section 570 is coupled to backplate 550 along section 578. Although only one support structure 571 is shown, this support structure 571 is representative of the other support structure.

FIG. 4(*f*) depicts a front view of a mounting module 103. As seen in FIG. 4(*f*) mounting module 103 includes backplate 550 and support structures 571. As noted above, each support structure 571 includes a structural element section 570 and a coupling bracket section 575 integrated into the exterior side of structural element section 570. Each support structure 571 also has a lower lobe 579 (FIGS. 4(*a*)-(*b*)) that is bent so that the lobe extends into the interior of mounting bracket 103. Backplate 550 includes aperture 114.

Figure 5A:
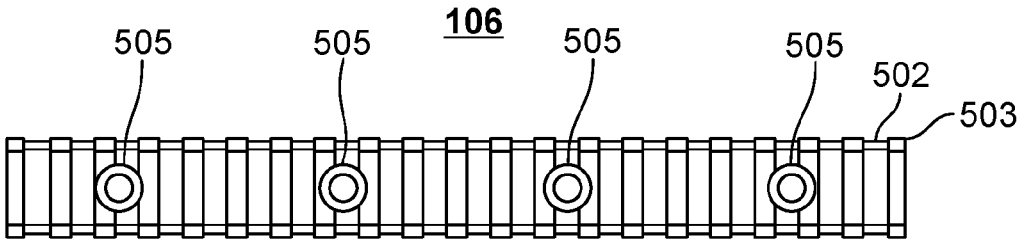
FIGS. 5(*a*) and 5(*b*) depict the rail system of FIG. 1 in greater detail.
Figure 5B:
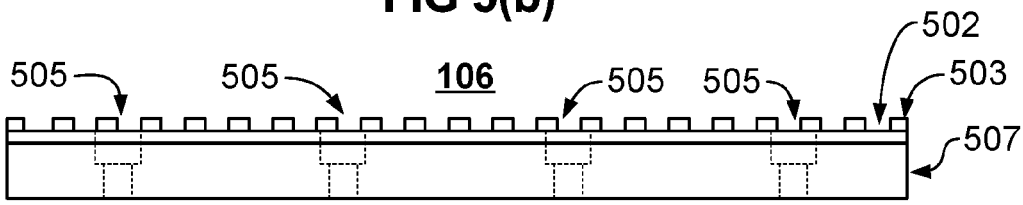
Figure 6A:
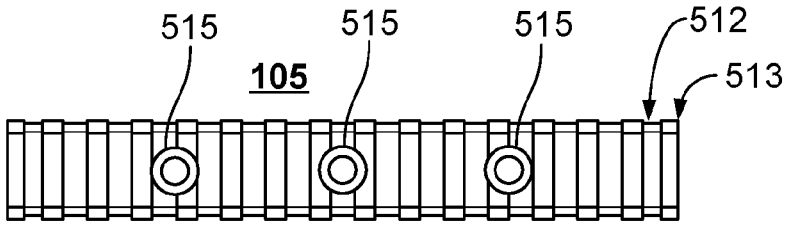
FIGS. 6(*a*) and 6(*b*) depict a second rail system of FIG. 1 in greater detail.
Figure 6B:
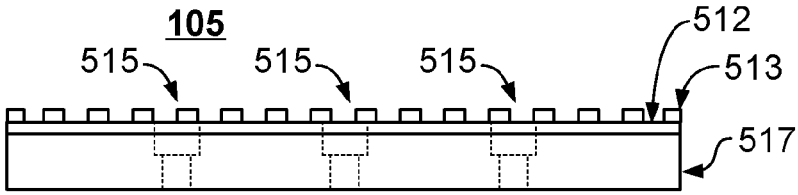

FIGS. 5(*a*) and 5(*b*) and FIGS. 6(*a*) and 6(*b*) depict rail systems that can be employed on the accessory interface system 100. A rail system can be, for example, a picatinny or MIL-STD-1913 rail. FIG. 5(*a*) depicts a top view of mounting rail 106. Mounting rail 106 includes a top surface 503 and grooves 502 in the top surface 503. Mounting rail 106 also includes a plurality of apertures 505 used to couple the mounting rail 106 to another structure. FIG. 5(*b*) depicts a side view of mounting rail 106. As seen in FIG. 5(*b*), mounting rail 106 includes a top surface 503 and grooves 502 in the top surface 503. The mounting rail also includes a side 507. The spacing, size, depth and arrangement of the apertures, top surface, sides, and grooves are dependent on the application and desired characteristics of the designer. The size and spacing of the apertures should correspond with the desired mounting apertures on the forward module 101 or the ancillary rail module 102. Although depicted as mounting rail 106 being different from mounting rail 105, the invention is not so limited. For example, mounting rail 106 can be the same as mounting rail 105. Alternatively, mounting rail 106 can be similar to mounting rail 105, e.g., where both have similar design features with the significant exception that one mounting rail is longer than the other mounting rail. Furthermore, although the invention depicts using a rail system as a method for coupling an accessory(ies) to an accessory interface system, the invention is not so limited.

FIG. 6(*a*) depicts a top view of mounting rail 105. Mounting rail 105 includes a top surface 513 and grooves 512 in the top surface 513. Mounting rail 105 also includes a plurality of apertures 515 used to couple the mounting rail 105 to another structure. FIG. 6(*b*) depicts a side view of mounting rail 105. As seen in FIG. 6(*b*), mounting rail 105 includes a top surface 513 and grooves 512 in the top surface 513. The mounting rail 105 also includes a side 517. The spacing, size, depth and arrangement of the apertures, top surface, sides, and grooves are dependent on the application and desired characteristics of the designer.

Figure 7:
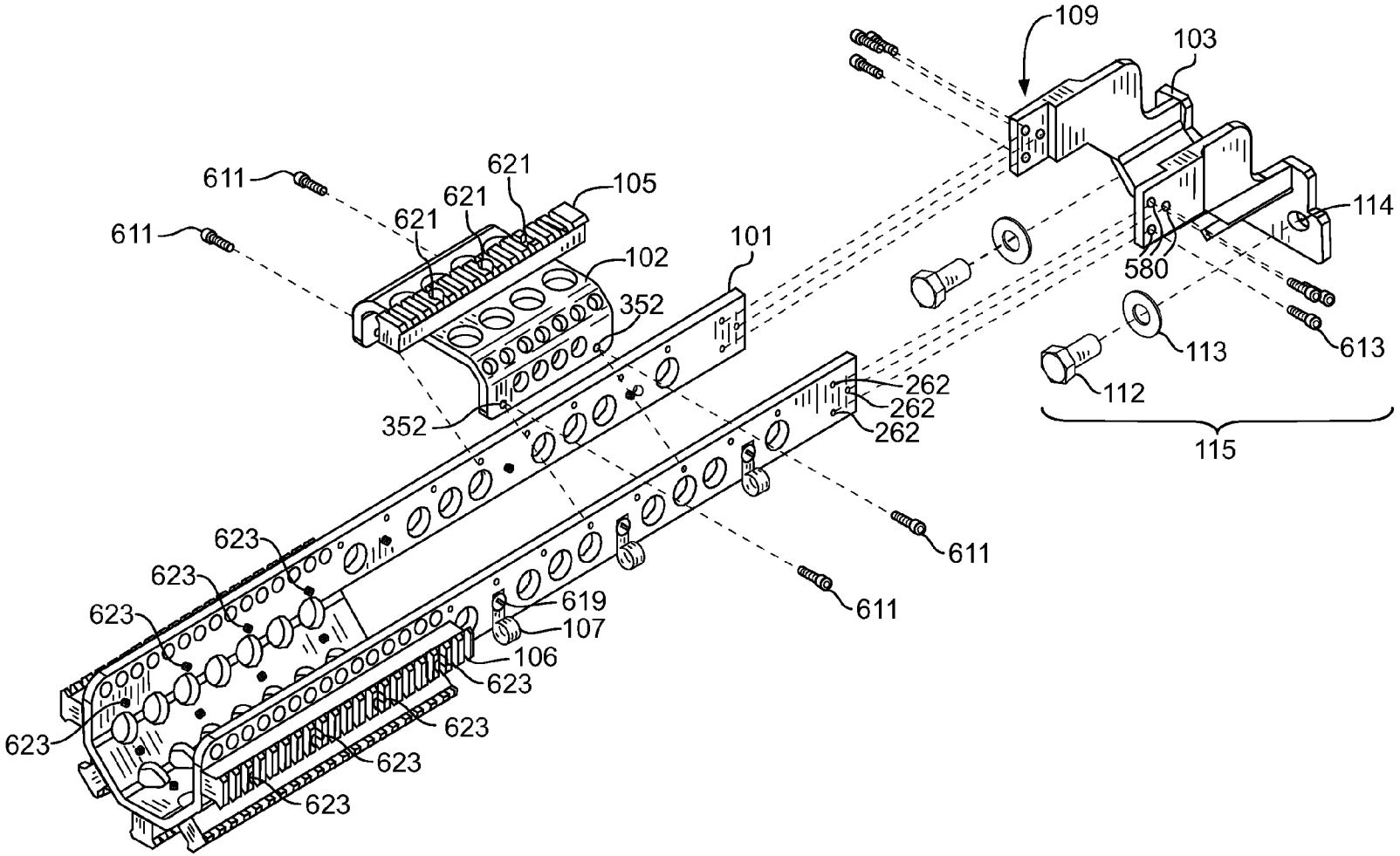
FIG. 7 depicts the assembly of components parts of the accessory interface system.

FIG. 7 depicts the assembly of components parts of the accessory interface system 100. As seen in FIG. 7, five rails 106 have been coupled to the forward module 101. Apertures 505 (FIG. 5(*a*)) in a rail 106 have been lined up with corresponding apertures 230 (FIG. 2(*c*)). A fastener 623 couple a rail 106 to the forward module 101. Collateral clamps 107 have been coupled to forward module 101 using fasteners 619 which pass through an aperture (not shown) in collateral clamp 107 and into a corresponding aperture 256 (FIG. 2(*c*)) in forward module 101. Although only one side of forward module 101 is depicted, the features depicted in this side are representative of features also present in the other side.

As seen in FIG. 7, rail 105 has been coupled to ancillary rail module 102. Apertures 515 (FIG. 6(*a*)) in a rail 105 have been lined up with corresponding apertures 330 (FIG. 3(*c*)). Fasteners 621 couple a rail 105 to ancillary rail module 102. Ancillary rail module 102 is coupled to forward module 101. Apertures 352 (FIG. 3(*d*)) in ancillary rail module 102 have been lined up with corresponding apertures 252 (FIG. 2(*c*)). Fasteners 611 couple ancillary rail module 102 to the forward module 101.

In an exemplary embodiment, the forward module 101 provides several locations to mount ancillary rail module 102. Although weapon sights are often placed to the rear of a weapon, some weapon users may opt to mount a sight further away for increased eye relief. Some weapon users may also choose to use two sights, each zeroed for a different distance. Thus, an easily movable ancillary rail module 102 provides flexibility in placement of a sight or other accessory for use with a weapon.

Mounting module 103 is coupled to forward module 101. Apertures 580 in mounting module 103 have been lined up with corresponding apertures 262 (FIG. 2(*c*)). Shear fasteners 613 couple mounting module 103 to the forward module 101. The accessory interface system 100 offers at least one designed failure point so as to prevent damage to the weapon mount or a weapon mounted on the weapon mount. If the accessory interface system 100 becomes overloaded or exposed to too much stress or force, the shear fasteners 613 will shear and cause the accessory interface system, or at least a portion of the accessory interface system 100, to effectively break-away, leaving the weapon functional and the weapon mount unaffected. The designed failure point, breakaway section 109, permits forward module 101 to break away from mounting module 103. The designer determines what is required to trigger the forward module 101, due to, e.g., excess shear force or load on the forward module 101, to break away. In an embodiment, the selection and arrangement of the method of fastening forward module 101 to mounting module 103 mostly dictates the breakaway parameters. For example, the selection and employment of six, quarter inch (¼") diameter stainless steel fasteners (e.g., screws) for use as shear fasteners 613 provides a calculable amount of force necessary to shear the shear fasteners 613 and decouple forward module 101 from mounting module 103. Ideally, the force required to break away is less than a force that would damage, impact, or impair the weapon in the weapon mount and or weapon mount connected to the accessory interface system. Although stainless steel fasteners are disclosed for use as shear fasteners 613, the invention is not necessarily limited, and any appropriate fastening system can be employed. In a various aspect, not disclosed in the Figure, a fastening system coupled to the forward module 101 is employed which permits quicker/easier retrieval of the forward module 101 in the event that the forward module 101 breaks off from the mounting module 103. The retrieval system is, for example, a lanyard or retaining wire, coupled to at least one point on the forward module 101 and at least one point on the mounting module 103.

The fastening system 115 employs the bolts 112 to fasten the mounting module 103 to the weapon mount (not shown), where the bolts 112 may be the bolts previously existing in the weapon mount. Alternatively, bolts 112 are similar to the bolts previously existing in the weapon mount but are slightly longer to account for the mounting of the accessory interface system 100. Using the mounting system previously existing in the weapon mount enables retaining the buffer system of the weapon mount.

In another aspect, a second designed failure point is included to permit ancillary rail module 102 to break from the forward module 101 in the event that a large stress or shear force(s) is applied to the ancillary rail module 102. In the event, for example, that the forward module 101 broke off from the mounting module 103, the ancillary rail module 102, (being coupled to the forward module 101) would be resting on a barrel of a weapon in the interior space of the accessory interface system 100; whereby the ancillary rail module 102 would be supporting the forward module 101 and anything coupled to the forward module 101. Therefore, it could be desirable to have a second engineered failure point in the system that couples the ancillary rail module 102 to the forward module 101. Accordingly, the ancillary rail module 102 would break off from the forward module 101 and reduce the chance that ancillary rail module 102 will damage and/or effect the operation of the weapon. Alternatively, a retrieval system is employed to couple the ancillary rail module 102 to the forward module 101 or the mounting module 103, to permit quick retrieval of the ancillary rail module 102. An example fastening system could include a flexible lanyard (not shown) which couples the ancillary rail module 102 to the forward module 101. The flexible lanyard could also have quick release pins which couple one or both ends of the lanyard to a particular component (e.g., 101, 102). Consequently, retention and implementation of the desired second engineered failure point is considered in the selection and implementation of appropriate fastening mechanisms, e.g., screws or bolts 611. Examples of such fastening mechanisms include shear fasteners or bolts which have a desired shear strength which is more than the force associated with typical use and forces arising from accessories which are coupled to various components such as the forward module 101, ancillary rail module 102, and/or mounting module 103.

Figure 8A:
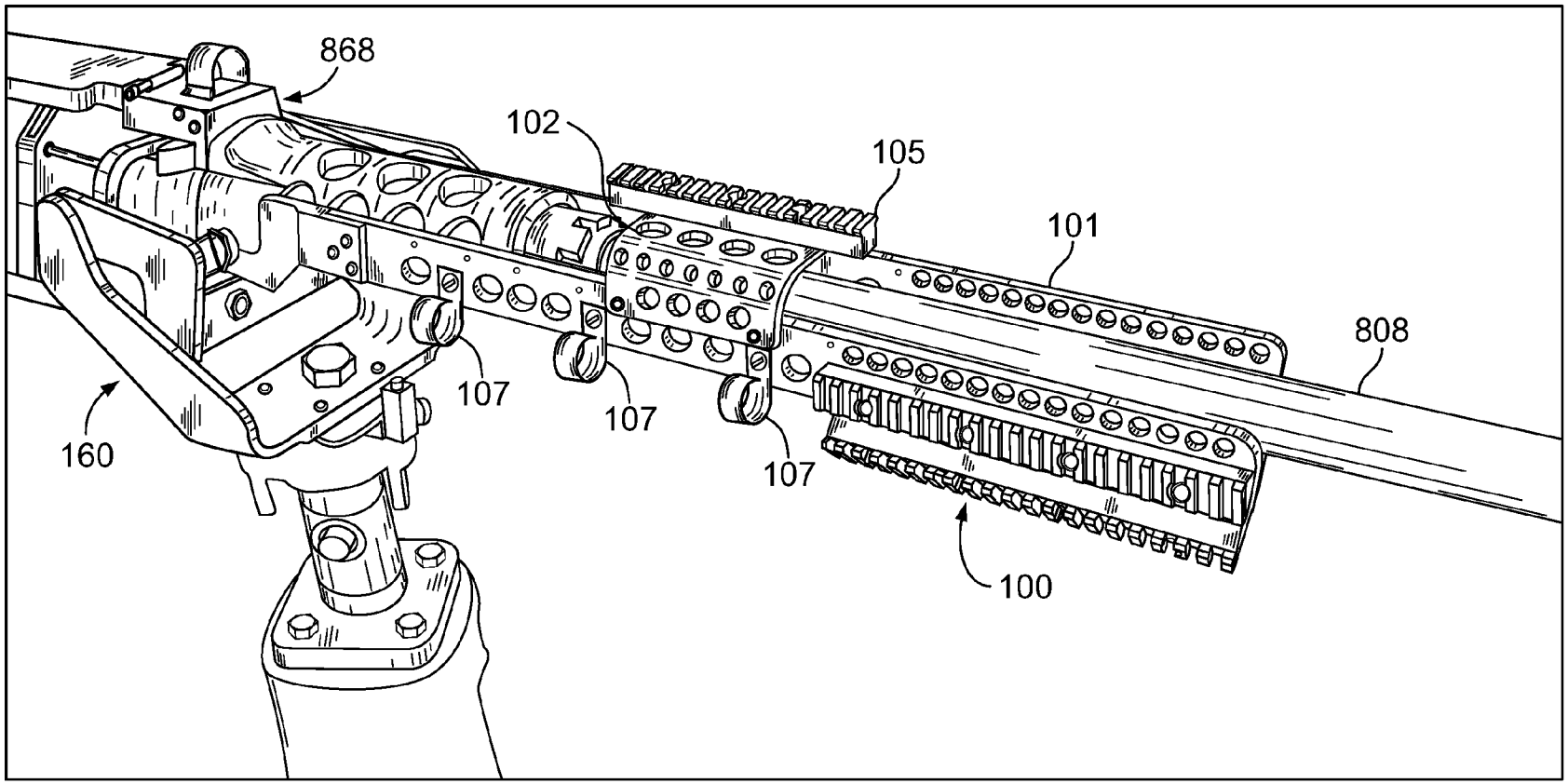
FIGS. 8(*a*)-(*c*) depict the accessory interface system in application with a weapon and weapon mount.
Figure 8B:
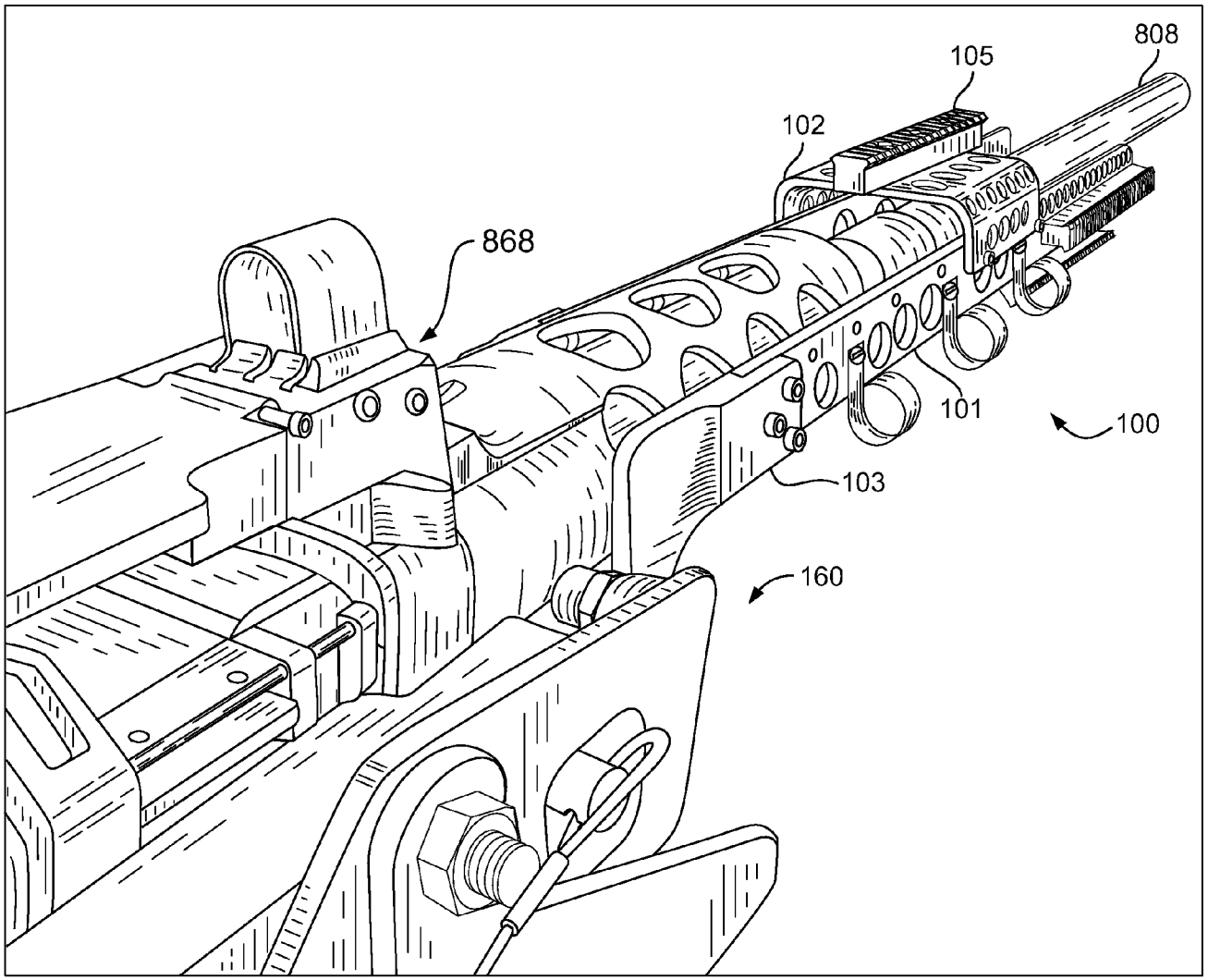
Figure 8C:
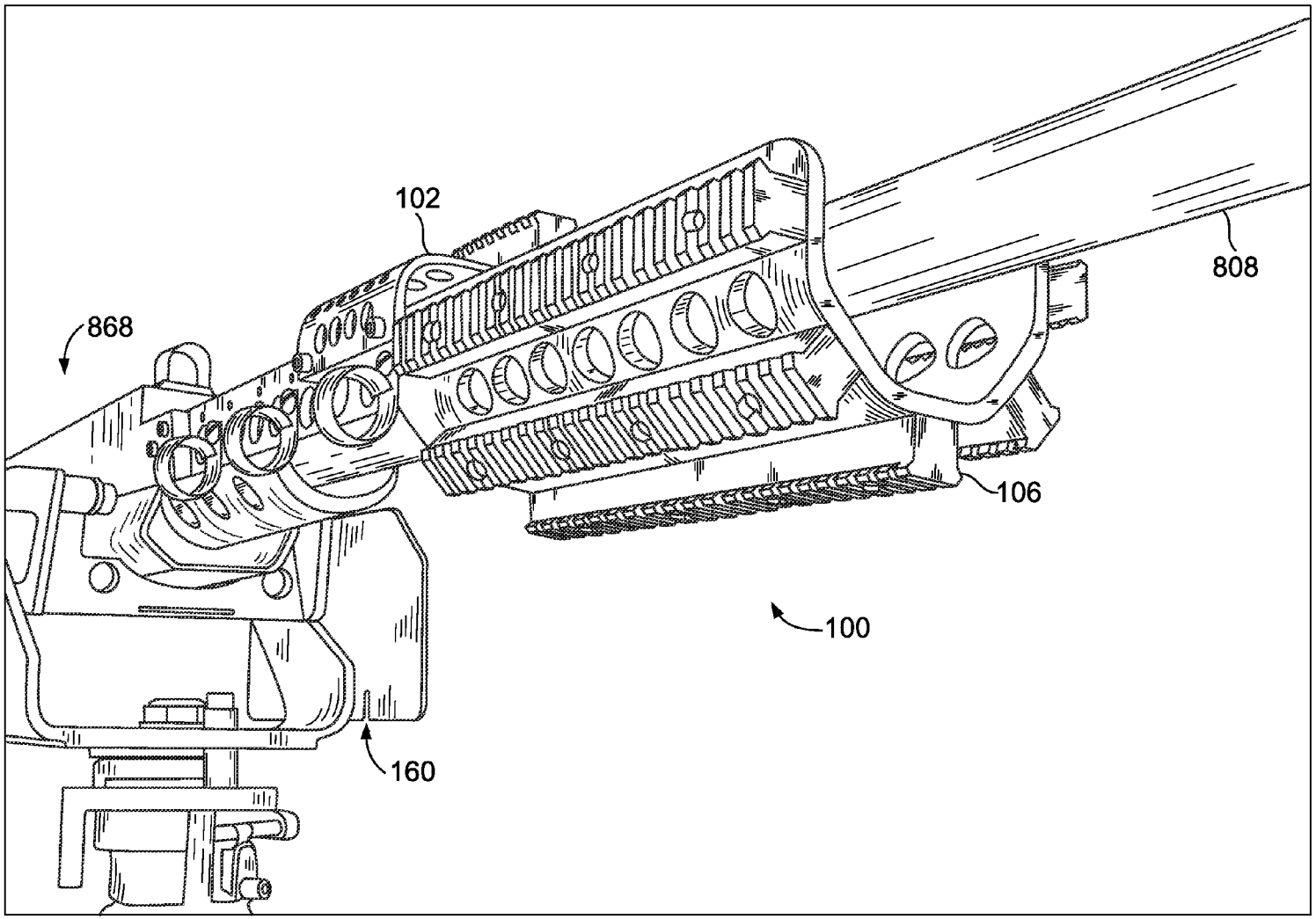

FIG. 8(*a*)-(*c*) depict the accessory interface system 100 in application with a weapon and weapon mount. FIG. 8(*a*) depicts a side perspective view of accessory interface system 100 surrounding a weapon 868 which is mounted on a weapon mount 160. The accessory interface system 100 also provides flexibility in use. For example, the accessory interface system 100 includes five mounting surfaces 210, 212, 214, 216, 218 (e.g., FIGS. 2(*a*)-(*d*)), plus the mounting surface of the ancillary rail module 102, where each mounting surface is aligned with a common centerline or central axis. This centerline coincides directly with the radial axis of a bore or barrel of the weapon 808. In an approach, each mounting surface is equidistant from the common centerline. In the case of a laser, once the device is zeroed at one location of a mounting surface, it can be mounted on any of the other mounting surfaces and retain zero. The same laser bore sight chart can also be used to zero the laser regardless of which mounting surface the laser uses; thus, different bore sight chart are not necessarily required for each mounting surface. Similarly, an optical sight can be placed on one mounting surface and zeroed. The optical sight can be moved and mounted on another mounting surface and the optical sight will not require adjustment to be zeroed. In a preferred approach, similar rails are mounted on each of the mounting surfaces, such that the rail will not affect the alignment of devices mounted on the rail. Thus, for example, an optical sight can be mounted on a rail system that is, in turn, mounted on one mounting surface and zeroed. The optical sight can be moved and mounted on a rail system that is, in turn, mounted on another mounting surface and the optical sight will not require adjustment to be zeroed.

As noted above and depicted in FIG. 8(*a*), the accessory interface system 100 provides for cable management. Lights and lasers can be controlled remotely at the rear of the weapon via cables. These cables are held along the rail via collateral clamps 107, preventing the pinching or melting of cables. This minimizes having cables that are free to hang loose or the need to secure cables using zip-ties. With an open design, the collateral clamps 107 allow for the quick attachment and removal of cables, unlike zip-ties which are more permanent in nature and must typically be cut off, possibly resulting in the inadvertent cutting of a cable. For example, a collateral clamp 107 is formed from ½ inch (½") wide by three inch (3") strip of nylon, having a loop of approximately one and one quarter inch (1½") diameter on one end and the other end of the nylon strip is coupled to the forward module 101. The loop can be pulled open, cable placed in the interior space, and the loop released, thereby reforming the loop with the cable inside. Although the cable clamp is described with respect to be fashioned from nylon and in the shape of a loop, the invention is not so limited.

FIG. 8(*b*) depicts a forward-looking, side perspective view of accessory interface system 100 surrounding a weapon 868 which is mounted on a weapon mount 160. As depicted in the figure, the barrel of the weapon 808 is located within the interior space of the forward module 101. The barrel of the weapon 808 is also located within the interior space of the ancillary rail module 102 which has a rail 105 fastened on top of the ancillary rail module 102. Also depicted is a portion of mounting module 103 coupled to forward module 101.

FIG. 8(*c*) depicts a forward-looking, side perspective view of accessory interface system 100 surrounding a weapon 868 which is mounted on a weapon mount 160. As depicted in the figure, the barrel of the weapon 808 is located within the interior space of the forward module 101 which has five (5) rails 106 fastened on it. The barrel of the weapon 808 is also located within the interior space of the ancillary rail module 102. As noted above and depicted with reference to, for example, FIG. 8(*a*), an advantage of having the accessory interface system 100 coupled to sections of a weapon mount in such a way as to avoid structure directly underneath the weapon is that this approach does not significantly impact or limit the depression of the equipment item or weapon nor does it significantly impact or limit the range of motion of the weapon having the accessory interface system 100. This difficulty with range of motion was discovered after attempts were made to create a mount with mounting structure underneath a weapon, e.g., under a barrel of the weapon 808 section. Other advantages exist including avoiding certain types of stress loading on a structure which passed underneath a portion of the barrel of a weapon 808 in closer proximity to a weapon mount 160.

Figure 9:
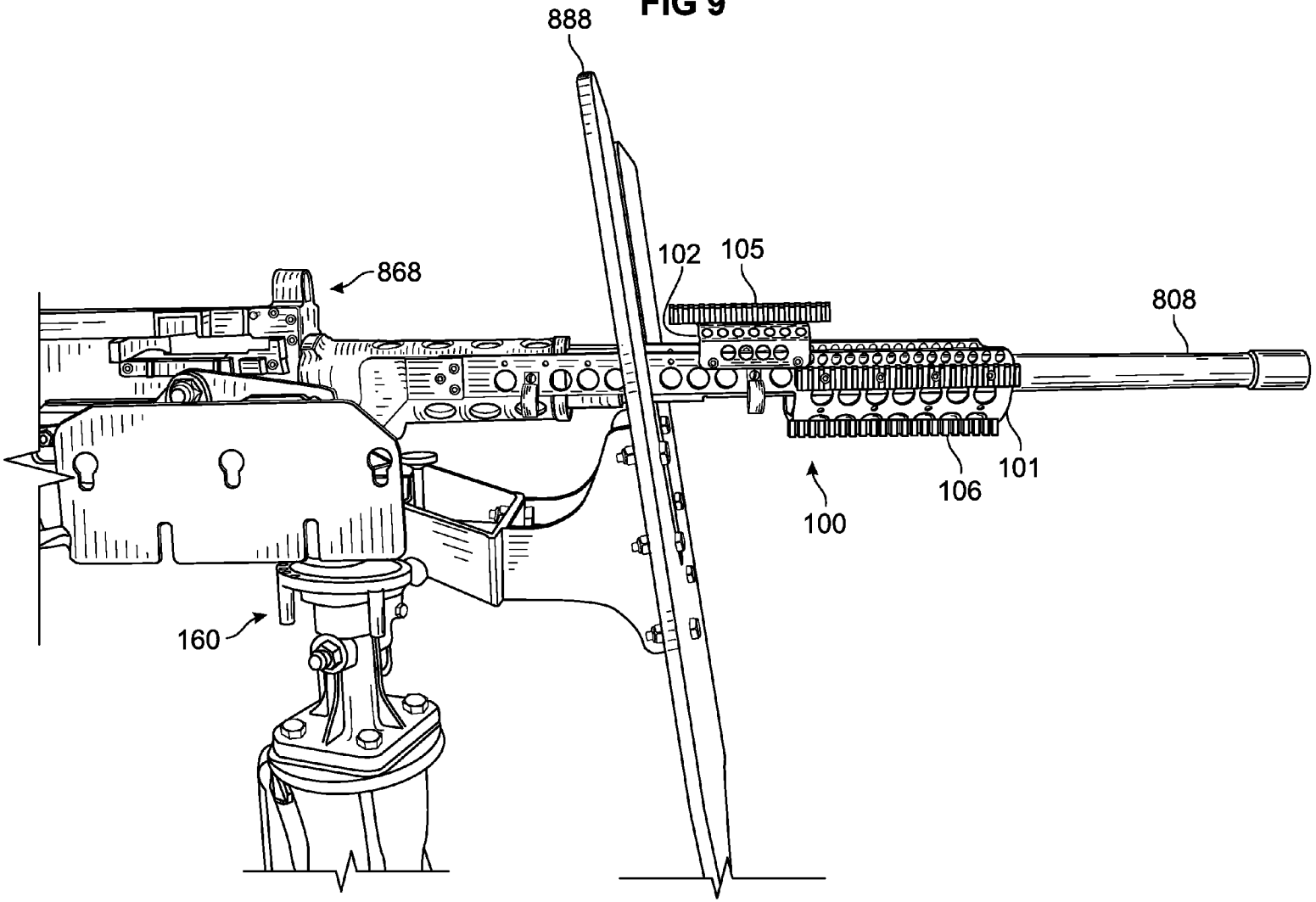
FIG. 9 depicts the accessory interface system in application with a weapon, weapon mount, and ballistic shield.

FIG. 9 depicts an accessory interface system in application with a weapon and weapon mount and a ballistic shield. FIG. 9 depicts a side perspective view of accessory interface system 100 surrounding a weapon 868 which is mounted on a weapon mount 160. As depicted in the figure, the barrel of the weapon 808 is located within the interior space of the forward module 101. The barrel of the weapon 808 is also located within the interior space of the ancillary rail module 102 which has a rail 105 fastened on top of the ancillary rail module 102. A ballistic shield 888 is shown coupled to mount assembly 160 (e.g., see FIG. 1). In another approach, ballistic shield 888 may be coupled in whole or part to the rail 105 (or 106) where it is not undesirable for the ballistic shield to also detach when an engineering failure point which couple the rail 105 to the mount assembly 160, e.g., 613, shear away. The ballistic shield preferably is made from a material which provides protection from projectiles or shrapnel and can also be designed to provide cover and concealment from a hostile party e.g., a sniper. The ballistic shield may also have structures which provide only concealment such as a fabric cover which extends beyond one or more edges of a hardened area of the shield which can also be designed to be fire retardant. Although the accessory interface system 100 is shown with an exemplary ballistic shield 888, any reasonably shaped and sized ballistic shield 888 can be employed, as well as multiple same or different ballistic shields can be employed contemporaneously or individually.

Efforts to design accessory mounting systems have run into a wide variety of problems or operating mode limiting design choices. The various problems associated with current art accessory mounting designs are increasing rather than decreasing given an increased desire to have a wider variety of accessories in use under an increasing variety of operating conditions. In the development of the above referenced invention, finite element modeling and analyses were performed for an accessory interface system 100 which maximized the number and variety of accessories, increased the number of ballistic or other type of shield/shrouds which could be used, addressed a variety of shortcomings associated with existing designs (e.g., weight, power management, range of motion, traversal, or elevation associated with equipment/weapon utilization), and reduced risks associated with a number of operating conditions/events. Testing was also accomplished to ensure various embodiments of an equipment/weapon and accessory mounting system was compatible for use with a weapon mount 160 in order to determine the structural integrity of an accessory interface system 100 under shock loading. This analysis was also conducted due to the need to ascertain the reliability of the accessory interface system 100 given it was found that initial selections of various combinations of components did not yield predictable results other than equipment failure or rejections of existing or experimental designs by various user classes. Thus, extensive testing was required in order to ascertain which designs would function as intended under the conditions that the various systems were to be employed. During these analysis efforts, experiments were conducted including ones on weld size and geometry as well as shear fastener sizes and specifications. In the course of the testing, including testing described herein, various design changes had to be made given testing results showed design failure in various component choices and design features for the combination of features, capabilities, and structures associated with various embodiments of the invention in this case. These analyses included finite element analysis modeling a heavy accessory mounted to an exemplary accessory interface system 100 where the accessory was a 10 lb spotlight (not shown).

One analyses consisted of a series of static and dynamic analyses. One static analysis was performed to determine preferred weld sizes and geometry and to also determine various worst case loading scenarios. Once design changes were made, revised models were subjected to a more severe dynamic shock loading analysis as outlined in MIL-STD-810. Separate models were constructed for the side, angle, and bottom mounted accessory configurations.

Various accessory interface system 100 parts were constructed of a fine mesh of three dimensional solid elements. Selected accessory interface system 100 parts were assigned material properties 4340 steel in accordance with AMS 6414. The weapon mount front cross member 161 was given material properties of 17-4PH H900 stainless steel. Pertinent material properties are listed in Table 1. The shear fasteners 613 and bolt 112 were modeled using rigid beam elements. The weapon mount cross member (e.g., 161) was rigidly constrained on its left and right surfaces. Contact interactions were defined between bolted or fastened connection contacting surfaces. An exemplary accessory, e.g., a spotlight mass, was coupled to the appropriate mounting hole surfaces. In one test, it was located four inches from the mounting surface in the middle of the bolt hole pattern. Static 20 g inertial loads were applied to each model in the up, down, lateral, fore, and aft directions. A 20 g static load is one worst case load used to analyze helicopter structures for a potential aviation user.

TABLE 1

Material Properties

| Property | AISI 4340 | 17-4PH H900 |
|---|---|---|
| Density ($lb_{f\text{-}S2}/in_4$) | 0.000732 | 0.000735 |
| Young's Modulus (psi) | 29,000,000 | 28,500,000 |
| Poisson's Ratio | 0.32 | 0.27 |
| Tensile Yield Strength (psi) | 217,000 | 170,000 |
| Ultimate Shear Strength (psi) | 156,000 | 123,000 |
| Ultimate Tensile Strength (psi) | 270,000 | 190,000 |

Static modeling results for a number of embodiments showed worst case loads were in a down direction for the side and angle mount configurations. Additional tests showed a number of embodiments have a worst case load in a lateral direction for a bottom mount configuration Weld configuration and size for a number of embodiments were determined to be a 0.125 full penetration groove finished on both long sides of the weld joint with 0.06 fillet welds. Table 2 lists worst case stresses/safety margins for each component of certain embodiments for each load. All safety margins are based on ultimate stresses. Safety margins for exemplary bolts 112 were based ½-13 UNC 300 series stainless steel (i.e. ultimate tensile strength=80 ksi, ultimate shear strength=50 ksi). Exemplary safety margins for exemplary shear fasteners are based on #8-36UNF SAE grade 8 fasteners (i.e. ultimate tensile strength=150 ksi, ultimate shear strength=120 ksi). Static analysis for various redesigned embodiments found that the new combinations and components passed the worst case 20 g static loading testing.

TABLE 2

Static Analysis Summary

| | Side Mount 20 g's Down | | Angle Mount 20 g's Down | | Bottom Mount 20 g's Lateral | |
|---|---|---|---|---|---|---|
| Exemplary Component | Max Stress | MS | Max Stress | MS | Max Stress | MS |
| Rail 106 | 76970 | 2.50 | 69980 | 1.85 | 188900 | 0.43 |
| Backplate 550 | 219900 | 0.22 | 218800 | 0.23 | 217500 | 0.24 |
| Weapon mount Cross Member 161 | 175600 | 0.08 | 161700 | 0.17 | 142700 | 0.33 |
| Bolts 112 | N/A | 1.29 | N/A | 1.38 | N/A | 2.81 |
| Shear fasteners 613 | N/A | 0.00 | N/A | 0.03 | N/A | 0.04 |

Other tests were also completed to include a dynamic model test. The dynamic model set-up is similar to the static model set-up described above with the significant exception that the mesh is coarser and continuum shell elements were used instead of three dimensional solids. A rigid body, which was constrained in all directions, was placed inside the accessory interface system 100 to simulate movement of a heavy equipment item, such as a barrel of the weapon 808. The dynamic loads were applied as 40 g acceleration for a 23 ms duration and 75 g acceleration for a 13 ms duration sawtooth shock pulses in accordance with MIL-STD-810 Method 516.5 page 516.5-14.

Results of dynamic modeling for a number of embodiments focused on a side mount configuration loaded with a 75 g acceleration with a 13 ms duration shock pulse in the down direction which is worst case and most likely direction to be severely loaded in one or more field utilization scenario (e.g., river patrol boat, mobile firefighting, submersible, whaling, ship mounted, dismounted infantry, or other special operations). An exemplary bolt 112 under test fails at a time of 0.110 s. However, selected shear fasteners, e.g., 613, fail before that time (the right and left top shear fastener 613 at t=0.015 s, the left aft shear fastener 613 at 0.02 s, the right bottom shear fastener 613 at 0.035 s, and the right aft and left bottom shear fastener 613 at 0.065 s). Stress plots reveal that stress for the left section (viewed from the muzzle end of a weapon) of backplate 550 exceeds ultimate material strength (i.e. 260 ksi) at 0.0175 s. At t=0.035 s the exemplary weapon mount cross member 161 exceeds its ultimate stress of 190 ksi but the stress is localized.

Results from different analyses conducted on various embodiments found that redesigned accessory interface system 100 passed static 20 g loading. As discussed in Table 2, shear fasteners 613 likely have the lowest safety margin which was one goal of various embodiments design. Dynamic analyses revealed that two exemplary shear fasteners 613 would likely break before stresses throughout the rail, e.g., 100, exceed ultimate stress levels associated with one set of potential field conditions. One of the exemplary analysis models does not allow all of the shear fasteners 613 to "release" and thereby load the remaining shear fasteners, e.g., 613 at one potential point of failure. One means for determining if a shear fasteners 613 will shear sooner than expected is to insert failure criteria for the shear fasteners 613 or re-run an analysis from a point of failure without the shear fasteners 613 or additional actual shock testing. It may be desirable to increase the size of the fillet welds (e.g., welds coupling sections 570, 550 of mounting module 103) to an exemplary 0.090 inch at least on outer welds. The shear fasteners 613 can remain #8-36UNF SAE grade 8 screws or equivalent (i.e. minimum ultimate tensile strength=150 ksi, minimum ultimate shear strength=120 ksi).

In one exemplary embodiment, an accessory interface system 100 is modular. For example, a same type weapon is employed in different contexts, where the context dictates certain design features, e.g., length of the accessory interface system 100. An embodiment can be constructed by removing two mounting bolts e.g., 112, that fasten the accessory interface system 100 to a weapon mount 160, the accessory interface system 100 can be removed and a different accessory interface system 100 easily mounted in its place. Additionally, different devices or weapons are mountable on a same type of weapon mount 160. As such, it may be desirable to have different design features corresponding to a different device, respectively. As noted above, straightforward design modification can incorporate an exchange of one accessory interface system 100 for another accessory interface system 100, accessories and the ability to include accessories can be tailored to different devices on the weapon mount.

Although the invention may depict one method of fastening an element to another element, the invention is not so limited. Different methods of fastening can be employed as appropriate under the circumstances or as desired by the user or designer in view of a wide variety of design considerations and required testing to verify utility and safety of a particular design.

While the invention has been described and illustrated with reference to specific exemplary embodiments, it should be understood that many modifications and substitutions can be made without departing from the spirit and scope of the invention. For example, the invention describes using a rail system 106 on the forward module 101 and second rail system 105 on the ancillary accessory module 102, the invention is not so limited and any combination of rail systems can be used, preferable such that heights are substantially all the same (to maintain equidistance from common centerline of weapon) and use similar mechanisms to fasten the rail system to the accessory interface system 100. Accordingly, the invention is not to be considered as limited by the foregoing description but is only limited by the scope of the claims.

What is claimed as new and desired to be protected by Letters Patent of the United States is:

1. An accessory interface system for coupling an accessory to a mount, comprising:

a first module of the accessory interface system adapted to be coupled to a first equipment item mount, said first module section comprises a first shear coupling section and a substantially non-shear coupling section, said substantially non-shear coupling section is adapted to couple said first module to said first equipment item mount; and a second module of the accessory interface system adapted to be coupled to said first module, said second module having a plurality of mounting surfaces, wherein said second module further comprises a second shear coupling section adapted to be coupled with said first shear coupling section, said first shear coupling section and said second shear coupling section adapted to maintain coupling and relative position to each other up to a first force is being applied to said first shear coupling section or said second shear coupling section, said coupling between said first shear coupling section and said second shear coupling section being adapted to shear when at least a second force applied to said first shear coupling section or said second shear coupling section, said first force being approximately a 20G load or greater.

2. The accessory interface system of claim 1, wherein said second force is at least 120 kilograms per square inch.

3. The accessory interface system of claim 1, wherein said second force is at least 175 kilograms per square inch.

4. The accessory interface system of claim 1, wherein each of said plurality of mounting surfaces being substantially aligned and substantially equidistant with respect to a common center line in an interior radial axis of the second module.

5. The accessory interface system of claim 1, further comprising a protective shield or structure coupled to said first equipment mount such that said first or second module passes through or extends beyond a section of said protective shield, said protective shield is adapted to substantially maintain structural integrity and relative position with said first equipment mount upon impact with one or more ballistic objects having up to a predetermined impact force.

6. The accessory interface system of claim 1, wherein said first force being less than said second force.

7. The accessory interface system of claim 1, further comprising a third module adapted to be coupled to said second module, said third module having a mounting surface being substantially aligned and substantially equidistant with respect to said common center line in said interior radial axis of the second module.

8. The accessory interface system of claim 1, further comprising:

a cable management system releasably coupled to said second module for managing at least one wire along the body of the accessory interface system.

9. The accessory interface system of claim 1, further comprising:

an optical sighting system releasably coupled to said second module for assisting a user in aiming a weapon coupled to said accessory interface system.

10. The accessory interface system of claim 1, further comprising:

a lighting system releasably coupled to said second module for assisting a user in viewing potential targets of a weapon coupled to said accessory interface system.

11. The accessory interface system of claim 1, further comprising:

a first rail system coupled to one of said plurality of mounting surfaces.

12. The accessory interface system of claim 11, further comprising:

a second rail system coupled to a second of said plurality of mounting surfaces, wherein a side of said second rail system distal from said second mounting surface and a distance from a side of said first rail system distal from said first mounting surface is substantially equidistant with respect to said common center line in said interior radial axis of the second module.

13. The accessory interface system of claim 1, further comprising:

a plurality of apertures in said first module, said plurality of apertures for reducing weight of said first module.

14. An accessory interface system for coupling an accessory to a mount, comprising:

a first module of the accessory interface system adapted to be coupled to a first equipment item mount, said first module having a left and right section, each of said left and right section having a longitudinal section substantially parallel to the other, said first module having a substantially open region above said left and right sections, and a second substantially open region below said left and right sections, each of said left and right section having a first shear coupling section and a substantially non-shear coupling section, said substantially non-shear coupling section of said left and right section are adapted to couple said first module to said first equipment item mount; and a second module of the accessory interface system adapted to be coupled to said first module, said second module having a second left and second right section, each of said second left and second right section having a longitudinal section substantially parallel to the other, wherein each of said second left and second right section comprises a second shear coupling section adapted to be coupled with said left and right section of said first shear coupling section, respectively, said first shear coupling section and said second shear coupling section being adapted to maintain coupling and relative position to each other up to a first force being applied to said first shear coupling section or said second shear coupling section, said coupling between said first shear coupling section and said second shear coupling section being adapted to shear when at least a second force applied to said first shear coupling section or said second shear coupling section.

15. The accessory interface system of claim 14, wherein said second module further comprises:

a first portion being proximal to said first module and a second portion being distal to said first module, said first portion including said second left and second right sections, each of said second left and second right section having a longitudinal section substantially parallel to the other, said first portion having a third substantially open region above said second left and second right sections, and a fourth substantially open region below said second left and second right sections.

16. The accessory interface system of claim 15, wherein said first and second structure modules are adapted to maintain structural integrity and rigidity with up to a first force applied to a portion of said second module.

17. The accessory interface system of claim 15, wherein said first force comprises a 20 kilogram load.

18. The accessory interface system of claim 15, wherein said first force comprises a 20 kilogram load applied at a distal end of said second module.

19. The accessory interface system of claim 15, wherein said second force comprises at least a 120 kilogram per square inch force.

20. The accessory interface system of claim 15, wherein said second force comprises at least a 175 kilogram per square inch force.

21. The accessory interface system of claim 15, wherein said second module comprises a plurality of mounting surfaces.

22. The accessory interface system of claim 21, where said accessory is an optical or aiming system.

23. The accessory interface system of claim 21, further comprising an accessory mounted on one of said plurality of mounting surfaces, where a structural integrity of said first and second modules substantially maintains a position and orientation of said mounted accessory.

24. The accessory interface system of claim 23, further comprising a second accessory mounted on another of said plurality of mounting surfaces, where the structural integrity of said first and second modules substantially maintains a position and orientation of said mounted accessory.

25. An accessory interface system for coupling an accessory to a mount, comprising:

a first module of the accessory interface system adapted to be coupled to a first equipment item mount, said first module section comprises a first shear coupling section and a substantially non-shear coupling section, said substantially non-shear coupling section is adapted to couple said first module to said first equipment item mount; and a second module of the accessory interface system adapted to be coupled to said first module, said second module having a plurality of mounting surfaces, wherein said second module further comprises a second shear coupling section adapted to be coupled with said first shear coupling section, said first shear coupling section and said second shear coupling section adapted to maintain coupling and relative position to each other up to a first force is being applied to said first shear coupling section or said second shear coupling section, said coupling between said first shear coupling section and said second shear coupling section being adapted to shear when at least a second force applied to said first shear coupling section or said second shear coupling section, said first force being approximately a 20G load or greater;

a third module adapted to be removably coupled to said second module, said third module having a mounting surface being substantially aligned and substantially equidistant with respect to said common center line in said interior radial axis of the second module;

a protective shield or structure coupled to said first equipment mount such that said first or second module passes through or extends beyond a section of said protective shield, said protective shield is adapted to substantially maintain structural integrity and relative position with said first equipment mount upon impact with one or more ballistic objects having up to a predetermined impact force;

a cable management system releasably coupled to said second module for managing at least one wire along the body of the accessory interface system;

an optical sighting system releasably coupled to said second module for assisting a user in aiming a weapon coupled to said accessory interface system;

a lighting system releasably coupled to said second module for assisting a user in viewing potential targets of a weapon coupled to said accessory interface system;

a first rail system coupled to one of said plurality of mounting surfaces of said second module;

a second rail system coupled to a second mounting surface of said plurality of mounting surfaces of said second module, wherein a side of said second rail system distal from said second mounting surface and a distance from a side of said first rail system distal from a first mounting surface is substantially equidistant with respect to said common center line in said interior radial axis of the second module;

a plurality of apertures in said first module, said plurality of apertures for reducing weight of said first module.

26. The accessory interface system of claim 25, wherein said second force is at least 120 kilograms per square inch.

27. The accessory interface system of claim 25, wherein said second force is at least 175 kilograms per square inch.

28. The accessory interface system of claim 25, wherein each of said plurality of mounting surfaces of said second module being substantially aligned and substantially equidistant with respect to a common center line in an interior radial axis of the second module.

29. The accessory interface system of claim 25, wherein said first force being less than said second force.

* * * * *